United States Patent [19]

Henley, Jr.

[11] Patent Number: 4,794,656

[45] Date of Patent: Jan. 3, 1989

[54] EMERGENCY BACKBOARD

[76] Inventor: Albert F. Henley, Jr., 213 Crabb Ave., Rockville, Md. 20850

[21] Appl. No.: 946,053

[22] Filed: Dec. 24, 1986

Related U.S. Application Data

[63] Continuation of Ser. No. 642,495, Aug. 20, 1984, abandoned.

[51] Int. Cl.[4] ..... A61G 1/00

[52] U.S. Cl. ..... 5/82 R; 5/431; 5/444

[58] Field of Search ..... 5/60, 81 R, 80, 82 R, 5/200 R, 431, 434, 437, 444; 128/87 R, 87 B, 134; 269/328; 297/391, 398, 406, 407

[56] References Cited

U.S. PATENT DOCUMENTS

| | | | |
|---|---|---|---|
| 270,724 | 1/1883 | Baldwin . | |
| 487,625 | 12/1892 | Kales . | |
| 648,453 | 5/1900 | Daly . | |
| 1,517,960 | 12/1924 | Cuccia . | |
| 2,014,478 | 9/1935 | Luetteke . | |
| 2,465,781 | 3/1949 | Banta . | |
| 2,481,741 | 9/1949 | Graves . | |
| 2,492,920 | 12/1949 | Koster . | |
| 2,535,559 | 12/1959 | Wolf . | |
| 2,607,050 | 8/1952 | Binschoff . | |
| 2,652,052 | 9/1953 | Smith . | |
| 2,675,564 | 4/1954 | Hughes . | |
| 3,286,708 | 11/1966 | Gartner . | |
| 3,650,523 | 3/1972 | Darby, Jr. . | |
| 3,672,364 | 6/1972 | Rankin . | |
| 3,707,734 | 1/1973 | Matthews . | |
| 3,737,923 | 6/1973 | Prolo . | |
| 3,995,822 | 12/1976 | Einhorn et al. . | |
| 4,252,113 | 2/1981 | Scire . | |
| 4,263,683 | 4/1981 | Knoke . | |
| 4,267,830 | 5/1981 | Vick . | |
| 4,369,982 | 1/1983 | Hein et al. . | |
| 4,447,922 | 5/1984 | Brochu . | |
| 4,571,757 | 2/1986 | Zolecki | 5/82 R |
| 4,640,275 | 2/1987 | Buzzese et al. | 5/437 |
| 4,655,206 | 4/1987 | Moody | 5/82 R |

OTHER PUBLICATIONS

The Aug. 1984 Issue of Emergency Magazine, pp. 11, 25 and 52 Catalog entitled Dyna Med, p. 104.

*Primary Examiner*—Alexander Grosz
*Assistant Examiner*—Michael F. Trettel
*Attorney, Agent, or Firm*—Hall, Myers & Rose

[57] ABSTRACT

A backboard for immobilizing and transporting injured persons and a head restraining device for employment with such a backboard is provided. The backboard includes a rigid support member, two head engaging members which are slidably received in a track attached to the rigid support member and latching assemblies to hold the head support members in a fixed position relative to the rigid support board. The head support members are designed to be positioned adjacent the head of an injured person who has been placed on the backboard, one head support member on each side of the head. The head support members may be completely removed from the track when not in use. The latching assemblies include a spring biased member which engages the track, due to the spring bias, and holds the head engaging member in a fixed position. The backboard may include body strapping members which include a cloth strap, a ring slidably and rotatably retained by one end of the strap and a snap hook swivelly connected to each ring. The snap hooks are connectable to rods embedded in the hand holds of the support board or to the rings of other strapping members. The backboards may include a foot support assembly which includes a foot plate and two extension members. The foot plate is rotatably attached to two extension members which in turn are slidably attached to the support board.

36 Claims, 3 Drawing Sheets

FIG. 1
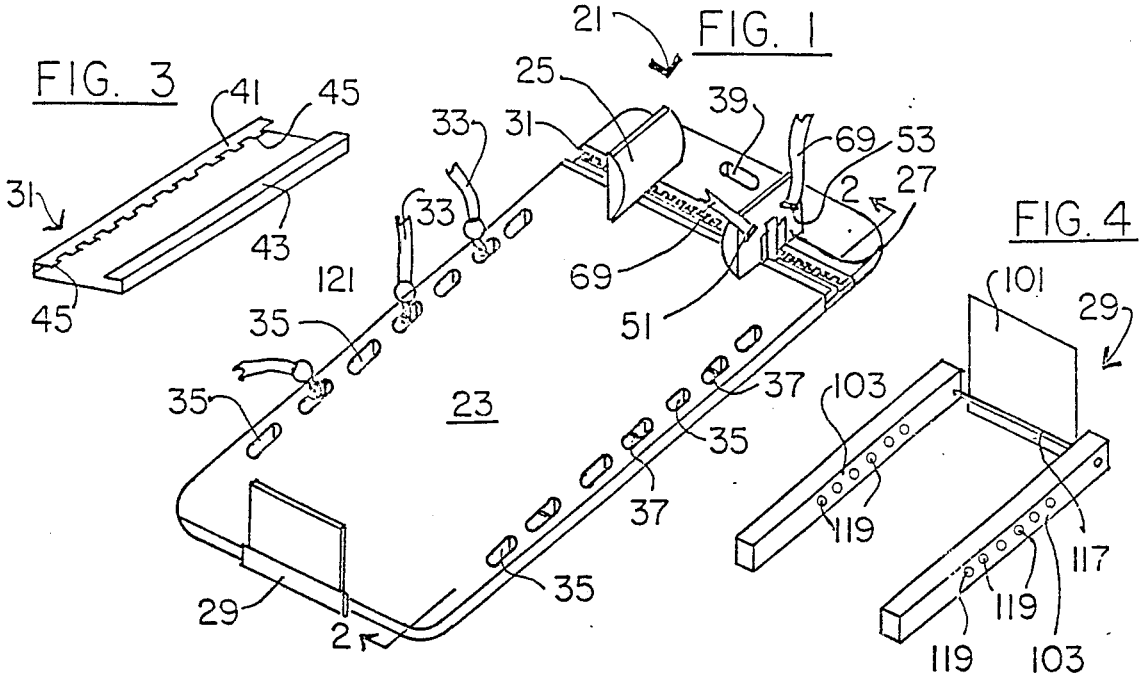
FIG. 3
FIG. 4
FIG. 2
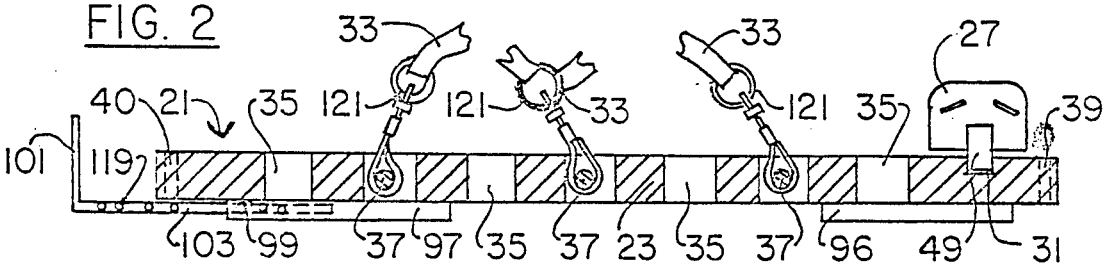
FIG. 5
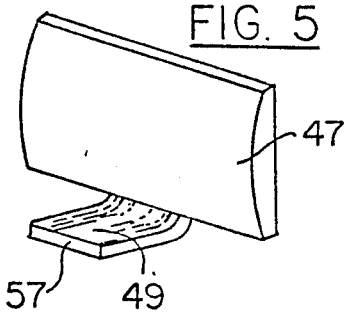
FIG. 6
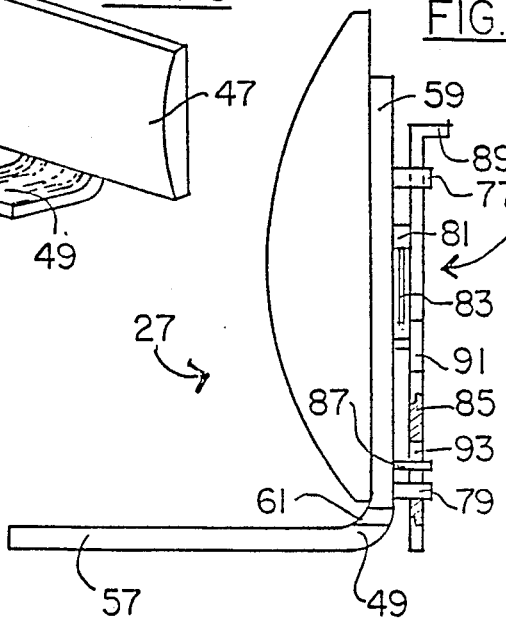
FIG. 7
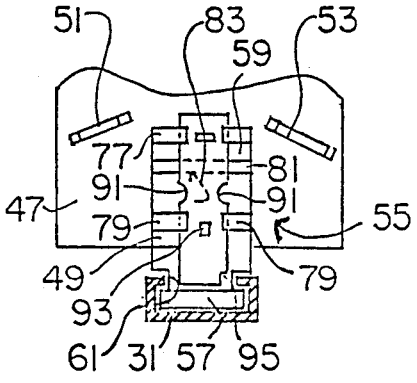

EMERGENCY BACKBOARD

This application is a continuation of Ser. No. 642,495, filed Aug. 20, 1984 now abandoned.

FIELD OF THE INVENTION

This invention relates to medical devices employed to immobilize and transport injured persons. More particularly, this invention relates to backboards upon which injured persons are placed and immobilized to transport the injured persons, usually from the scene of the injury to a medical care facility.

BACKGROUND OF THE INVENTION

Usually when an accident or a crime occurs which results in a serious injury to a person, a call is placed to a medical emergency mobile unit so that the emergency mobile unit can transport the injured person from the scene of the accident or crime to a medical care facility. The emergency mobile unit of course responds to the call and proceeds to the scene of the accident or crime.

When the emergency mobile unit arrives at the scene of the accident or the crime, the emergency medical personnel must initially and quickly evaluate the type and extent of the injuries of the injured person. If the emergency medical personnel determine that certain types of injuries have been sustained, such as a back, neck or head injury, then the emergency medical personnel must immobilize the injured person to prevent further injury to the injured person's spine, neck, etc. and/or to minimize the damage already incurred due to the accident or crime during the transport of the person to a medical care facility.

It is the current standard practice for emergency medical personnel to carry with them in their emergency mobile units what is known in the trade as a backboard. A backboard in this trade is a rigid board, large enough to place a person thereon, which is accompanied by straps that are compatible with the rigid board. The board and straps are designed such that a person can be placed on the board and strapped to the board in a stable position. Thus, the backboards fulfill the function of immobilizing an injured person in a position to prevent further injury to the person and/or to minimize the damage already inflicted by the injury during the transport of the person to a medical care facility.

The injured person is usually placed on the backboard by sliding, lifting or otherwise moving the injured person onto the backboard. The injured person is then usually positioned on the backboard in the desired position and strapped to the backboard. The speed and efficiency with which these tasks can be performed is crucial. A savings in time, in many instances, may prevent paralysis, prevent permanent bone damage, prevent brain damage and save lives. Likewise, the effectiveness of the backboard to retain and immobilize the person in the desired position may prevent paralysis, prevent permanent bone damage and save lives.

Therefore, there are two important factors to consider when determining the effectiveness and efficiency of a background, first, the speed at which a person can be placed upon the backboard and immobilized to the backboard and second, the effectiveness of the backboard in immobilizing the injured person in the desired position.

The backboards currently in use do, of course, perform as intended, that is, the backboards are employed to transport an injured person to a medical facility in a stable position. However, since the objective of all the backboards is to be designed such that the injured person can be quickly placed on the backboard once the medical unit has arrived at the scene and effectively immobilized for transport to a medical facility, there is always a need for a backboard which, when employed, enables the emergency crew to more quickly and effectively place the injured person on the backboard and immobilize the person in a desired position on the backboard. This invention addresses this need, as well as the other needs in the art which will become apparent to those skilled in the art once given the following disclosure:

Generally speaking, this invention provides: a backboard for transporting an injured person comprising a rigid support board of a size sufficient to lay a person thereon; means for strapping said person on said board, and means for supporting the head and neck of said person; wherein said head and neck supporting means includes a track which is connected to said board and two head engaging devices which are slidably received by said track, said head engaging devices including means for latching said head engaging devices in a number of positions relative to said track, wherein each of said latching means includes a latch member having at least two positions, a latch position and a free position, said latching means being designed and arranged such that said head engaging devices are free to move relative to said track when the latch members are in the free position and such that said head engaging members are stopped from moving relative to the track when the latch members are in the latch position.

In some embodiments of the invention, the latching means includes a spring which biases the latch member in the latch position. The spring force must be overcome- to unlatch the latch member before the head engaging devices can be slid relative to the track.

In other embodiments, the track is embedded in the support board and is positioned transverse to the support board. This enables the emergency medical personnel employing the backboard to move a head engaging device in laterally from each side of the head of the injured person who has been placed on the backboard, perpendicularly to the injured person's head.

In yet other embodiments, each of the head engaging members may include a head support pad and a support guide. The support guide may have two legs, a first leg which is slidably received by the track and a second leg which is at an angle with the first leg and has the head support pad and the latch member attached thereto.

In some embodiments, the latch member may be slidably attached to said second leg of the support guide. In other embodiments, the latch member may be rotatably attached to the support guide.

In further embodiments, the latching member may be a plate or a rod which is slidably attached to the second leg of the guide member. The latching member may slide in a direction parallel to the second leg. The plate or rod interfaces with holes or notches in said track when said latch member is in the latch position.

In yet other embodiments, the latching member may be a bent plate which is rotatably connected to the second leg of the guide member. The bent plate may have a top and a bottom leg. The axis of rotation of the bent plate may be the line along which the plate is bent.

The spring may be positioned to push on the top leg of the bent plate and this spring force pushes the bottom leg of the latching plate into the guide, thus holding the head engaging member in place.

Yet other embodiments include strapping members for strapping the injured person to the backboard in order to restrain the injured person's movement and thus immobilize the injured person. The strapping members may include two straps which are buckled together much like a seat belt. Each strap has a connector at one end thereof for attaching the strap to the backboard, as discussed below. The connector may include a ring which is rotatably and slidably received by one end of the strap and a snap hook which is in turn swivelly connected to the ring.

The support board may have handholds spaced along each longitudinal edge thereof. Some of these handholds may have rods located therein which span either the length or width of the handholds. The snap hooks of the strapping members can be easily and quickly attached to these rods.

Some embodiments of the invention may include a feet support assembly. The feet support assembly may be comprised of a foot plate rotatably attached to two extension rods. The extension rods slide in tubes attached to the underside of the support board and are adjustable relative to the support board such that the position of the foot plate may be adjusted, dependant on the height of the person placed on the backboard. The feet support assembly may also include a latching assembly which latches the foot plate and extension rods in a number of positions.

The backboards according to this invention have many advantages over the prior backboards, including:

The backboards according to this invention enable medical personnel to more quickly place a person on a backboard, support the person on the backboard and restrain the person's movements (thus immobilizing the patient) than possible employing the prior backboards. As stated above, the faster and more effectively these tasks can be accomplished, the greater the possibility the medical personnel have of minimizing the damage already inflicted on the person, of preventing further injury and/or saving a life.

One of the features which makes the backboards according to this invention faster to employ is that when the emergency personnel with such a backboard arrive on the scene of the injury, the head engaging members are normally removed from the track and the foot plate tucked under the support board. Unlike some of the prior backboards, the injured person can then be easily slid or otherwise moved onto the support board from any direction since the backboard has a flat, unobstructed top surface when the head engaging members are removed and when the foot plate is tucked under the support board After the person is placed on the rigid board the head engaging members can be quickly and easily slid into the track and placed in the proper position adjacent the head of the injured person without further movement of the person. This feature is also not found in any of the prior backboards. The head straps can then be looped through strap handles which are a part of the head engaging members, tightened as appropriate and fastened.

Likewise, the body strapping members can be easily and quickly placed around the person to restrain the movement of the person's body. The body strapping members can be installed before, simultaneously or after the head of the injured person has been positioned and immobilized. The body strapping members according to this invention have many advantages over prior strapping members used with backboards, including the advantage of the capability to be quickly attached to the backboard.

The connectors of the straps, comprised of the rings and snap hooks, can be very quickly hooked onto the rods in the handholds. Also, due to the employment of the rings, the strap members can be attached together, that being, the snap hook of one strapping member can be attached to the ring of another strapping member, as described below.

Moreover, the strapping members according to this invention have the advantage of being quickly detachable from the backboard such that the injured person can be quickly released from the backboard once the injured person is in a medical care facility. The straps can be unfastened as quickly, if not more quickly, as the straps can be fastened.

If the strapping members have been connected by attaching one snap hook of a first strapping member to the backboard, while attaching the other snap hooks to the ring of the first strapping member, all the strapping members are released from the backboard by releasing the first snap hook. This makes it extremely quick and easy to unfasten the injured person once the injured person is in a full medical care facility. Emergency personnel, through experience employing backboards according to this invention, will learn how to connect the strap members such that the person can be unfastened from the backboard by unfastening one or two key snap hooks.

Also, since the snap hooks are swivelly attached to the rings, less time need be spent by the emergency medical personnel untwisting the strap members, etc.

Furthermore, the strap members are completely detachable from the backboard. Thus, the emergency medical personnel need not worry about the strap members as the person is being placed and positioned on the backboards according to this invention. Also, the employment of these strap members provides the emergency medical personnel great flexibility in how the straps are positioned around the injured person's body. When using the prior straps and backboards, the emergency- personnel are usually limited to connecting the body restraining straps in parallel between corresponding handholds located along each of the longitudinal edges of the backboards. When employing backboards according to this invention, the strap members can be connected between corresponding handholds, between the top handholds on one edge and the bottom handhold on the other edge or any other combination.

This flexibility further enables the field emergency personnel to position the strapping members to best restrain the injured person, dependant on the person's injuries. This capability may be crucial in the field to prevent aggravation of an injury.

The backboards of this invention have the further advantage of being compatible with a foot plate assembly which supports and restrains the feet of the injured person when necessary.

The backboards according to this invention also have the basic advantage that the injured party is effectively and securely restrained and supported by the backboard if the backboard is properly employed. The head is securely supported and restrained by the head engaging members to a degree not found when employing the prior backboards. The same is true for the body and feet of the injured person.

The backboards according to this invention will now be described as illustrated in the drawings wherein:

IN THE FIGURES

FIG. 1 is a perspective view of one embodiment of this invention.

FIG. 2 is a side view, sectionalized along line 2—2 of FIG. 1, of the embodiment of this invention illustrated in FIG. 1.

FIG. 3 is a perspective view of a track which can be employed in the embodiment of this invention illustrated in FIGS. 1 and 2.

FIG. 4 is a perspective view of a foot plate assembly (detached from the support board) which can be employed in the embodiment of this invention illustrated in FIGS. 1 and 2

FIG. 5 is a perspective view of a head support assembly (detached from the support board) which can be employed in the embodiment of this invention illustrated in FIGS. 1 and 2.

FIG. 6 is a side view, partially sectionalized for clarity, of the head support assembly illustrated in FIG. 5.

FIG. 7 is a partial rear view of the head support assembly illustrated in FIGS. 5 and 6, the head support assembly engaging the track shown in FIG. 3.

DETAILED DESCRIPTION OF THE DRAWINGS

Figure 8:
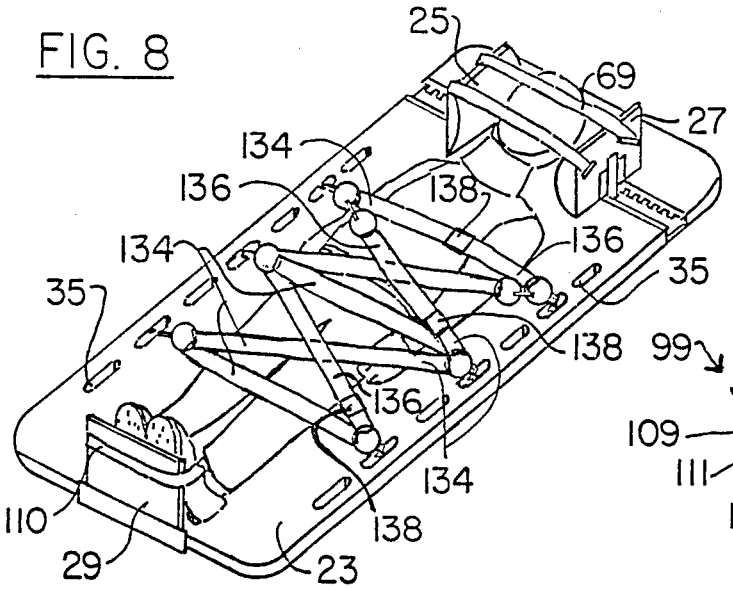
FIG. 8 is the same perspective view of the embodiment of this invention illustrated in FIG. 1, however, this Figure illustrates a person being retained on and supported by the embodiment.

Referring to the FIGS., in particular FIGS. 1 and 2, an emergency backboard 21 for transporting injured persons is illustrated including a rigid support board 23, a left head support assembly 25, a right head support assembly 27, a foot plate assembly 29, a head support track 31 and various body strap members 33.

Support board 23, in the embodiment illustrated in the FIGS., is comprised of wood and is of a size and thickness such that persons can be placed on board 23 and be fully supported by board 23 when board 23 and the person are being carried (transported). Support board 23 is designed such that two or more medical emergency personnel can carry the board 23 with an injured person strapped thereon (see FIG. 8). Thus, two or more persons can carry board 23 and the injured person at least from the scene of the accident or crime to the emergency mobile unit.

Backboard 23 has various handholds 35 spaced along the longitudinal edges thereof. Handholds 35 are elongated slots cut through support board 23 having a length and width at least such that a hand of a person will fit therethrough. This provides a means that the emergency personnel or others can grip to carry backboard board 21. Backboard 21 can be carried by having one emergency person on each side of support board 23 grasping two of the handholds 35 on that side.

Some of the handholds 35 have rods 37 secured therein for purposes described below. Rods 37 extend across the width of selected handholds 35.

Support board 23 may also include handholds 39 and 40 of the same size and shape as handholds 35. Handhold 39 is located in the top and handhold 40 is located near the bottom of support board 23. Handholds 39 and 40 are included so that a third and a fourth emergency person can grip the top and bottom of backboard 21, respectively, and assist in the carrying and positioning of support board 23. Support board 23 also has a lateral groove therein (not shown) which receives track 31.

Track 31, in all the embodiments illustrated in the FIGS. is an elongated track of a general channel cross-section having two retaining flanges, flanges 41 and 43. In the embodiment illustrated in FIGS. 1–3, 7 and 8, retaining flange 41 has teeth 45 which function to engage left head support assembly 25 and right head support assembly 27, as discussed below.

The elements comprising left head support assembly 25 and right head support assembly 27 are the same, the only difference being that the elements are reversed in direction. The head support assemblies 25 and 27 each include a support pad 47, bar support guide 49, strap hooks 51 and 53 and latching assembly 55.

Support pads 47 are in effect cushions which actually abut and engage the head of the injured person being carried on emergency backboard 21. Support pads 47 have a cushioning effect to protect the head of the injured person, yet are rigid enough to keep the head in a fixed position when head assemblies 25 and 27 are retaining the head of an injured person. Support pads 47 are affixed to support guides 49 by any of a number of well-known attaching devices and/or techniques, such as glue, screws, etc.

Support guides 49, in the embodiments illustrated in the FIGS., are L-shaped, having a track engaging leg 57 and an upright leg 59. Track engaging leg 57 and track 31 are designed and arranged such that track engaging leg 57 is slidably received by track 31. However, at the same time, track engaging leg 57 forms a snug fit with track 31 so that there is minimal movement (including rocking) between head support assemblies 25 and 27 and track 31 when head support assemblies 25 and 27 are in engagement with track 31.

Support guides 49 have a continuous width except for indented portions 61 (see FIGS. 6 and 7) which receive retaining flanges 41 and 43 when the head support assemblies 25 and 27 are properly inserted in track 31.

Figure 10:
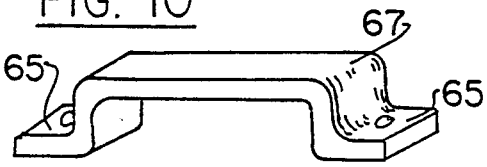
FIG. 10 is a perspective view of a strap latching rod which can be employed as a part of the head support assembly illustrated in FIGS. 5–7.

Strap hooks 51 and 53 (see FIG. 10) are connected at an angle to the back side of support pads 47, as shown in FIG. 7. In the alternative, it is obvious that strap hooks 51 and 53 can be attached to support guides 49 instead of to head support pads 47, depending on the size and shape of support guides 49. In the embodiment illustrated in the Figures, strap hooks 51 have two outer portions 65 which abut and are connected to support pads 47 and a center raised portion 67. As shown in the FIGS., center raised portion 67 provides a bar spaced from support pad 49 around which head straps, such as head straps 69, can be wrapped to secure and immobilize the head of an injured person being placed on emergency backboard 21.

Figure 13:
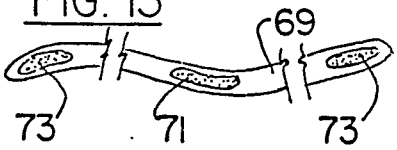
FIG. 13 is a perspective view of a head strap which can be employed with the embodiment of this invention illustrated in FIGS. 1 and 2.

Head straps 69 are elongated straps which have spaced VELCRO® patches attached thereto. In the embodiment illustrated in FIG. 13, the VELCRO® patches include center patch 71 and side patches 73. The head strap 69, after a head of an injured person is placed between left head support assembly 25 and right head support assembly 27 and these head supports assemblies are brought into abutment with the head, are woven under strap hooks 51 and 53, respectively, and folded such that side VELCRO® patches 73 are brought into engagement with center VELCRO® patch 71. This securely restrains the head of the injured person between the head support assemblies 25 and 27. In this embodiment, one head strap 69 is connected between strap hooks 51 and placed under the chin of the injured person and a second head strap 69 is connected between strap hooks 53 and supports the forehead region of the injured person.

Latching assembly 55 includes a pair of upper guides 77, a pair of lower guides 79, recoil bar 81, spring 83, latch plate 85 and pin 87.

Upper guides 77 and lower guides 79 are connected to upright leg 59 of support guide 49 and have a portion spaced from upright leg 59 such that latch plate 85 is slidably received by guides 77 and 79 and upright leg 59. In this respect, guides 77 and 79 can be of a channel cross section with latch plate 85 being received between the flanges of the channel, or of an "L" shape with the latch plate 85 being received between one leg of the "L" and upright leg 59.

Recoil bar 81 is a bar which is attached to upright leg 59 in the location shown in FIGS. 6 and 7.

Spring 83, in the embodiment shown in the Figures, is a tension wire spring attached to latch plate 85. Spring 83 is designed and positioned such that it holds latch plate 85 in the down or lock position and resists any upward movement of latch plate 85. The leaf of tension spring 83 abuts the underside of recoil bar 81 and is constantly pushing against recoil bar 81. Thus, any movement upward of latch plate 85 is a movement upward of spring 83 and is resisted by spring 83 pushing against recoil bar 81 which remains stationary.

Pin 87, in this embodiment, is a round pin which is removably attached to upright leg 59 and is oriented perpendicularly to upright leg 59 (see FIG. 6).

Latch plate 85 is a flat, generally rectangular, plate having a top lip 89, indents 91, slot 93 and notch 95 (see FIGS. 6 and 7). Top lip 89 extends outwardly from the top of latch plate 85 and provides a surface for a person to grip and/or push with a finger to raise latch plate 85.

Indents 91 are provided to assemble or disassemble latching assembly 55 as follows. If pin 87 is removed, latch plate 85 can be raised until indents 91 are in alignment with upper guides 77. At the same time, the bottom edge of latch plate 85 will be above lower guides 79. Latch plate 85 can then be pulled forwardly out of locking assembly 55.

Slot 93 is a rectangular slot designed to receive pin 87 therein. Slot 93 and pin 87 function- to retain latch plate 85 within guides 77 and 79 and further function to limit the amount of travel in the vertical direction of latch plate 85. Latch plate 85, when locking assembly 55 is properly assembled, can only travel downward until the top edge of slot 93 abuts pin 87 and can only travel upward until the bottom edge of slot 93 abuts pin 87.

Notch 95 is necessary so that the bottom edge of lock plate 85 will fit into and engage track 31. Notch 95 interfaces with retaining flange 43 in this respect. The bottom edge of plate 85 opposite notch 95 engages teeth 45 of track 31 (i.e. the edge fits in between adjacent teeth 45 and locks in place) and latches the head assembly in a fixed position.

Foot plate assembly 29 includes two receiving tubes 97, two sliding lock pin assemblies 99, foot plate 101 and two foot plate extension bars 103.

Receiving tubes 97 are connected to the bottom of backboard 23 parallel to the longitudinal direction of support board 23 and are spaced apart a desired distance. Receiving tubes 97 are hollow tubes of a size such that extension bars 103 are slidably received therein. Each tube has at least one hole therein (such as hole 98 in FIG. 9) to receive pins 105, as discussed below.

Figure 9:
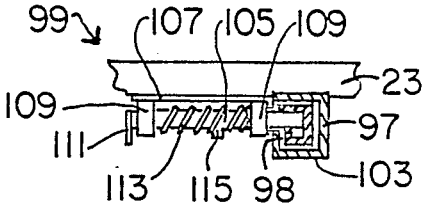
FIG. 9 is a side view, partially sectionalized, of a latching assembly which can be employed with the foot plate assembly illustrated in FIG. 4.

Sliding lock pin assemblies 99 are likewise mounted on the underside of backboard 23, one adjacent to each of the receiving tubes 97 (see FIG. 9). Sliding lock pin assemblies 99 include pin 105, mounting plates 107, pin guides 109, pull handle 111 and spring 113.

Guides 109 are attached to mounting plates 107 which are in turn attached to the underside of backboard 23. In this embodiment, mounting plates 107 are flat rectangular plates and guides 109 are "U" shaped, having the two edges of the "U" abutting plate 107.

Pin 105 is slidably received within two pin guides 109 and has knob 115 extending therefrom. Knob 115 is designed such that pin 105 can not be pulled out from guides 109 and also to engage spring 113, as discussed below.

Pull handle 111 is attached to the outer end of pin 105 and is provided so that a person can grasp pin 105 and pull it out of engagement with track 97. In some embodiments pin 105 and pull handle 111 may be an integral member.

Spring 113 is a small coil spring which circumferentially surrounds pin 105 and has its ends abutting the two guides 109. Knob 115 engages a midpoint of spring 113 so that if pin 105 is moved in either direction from its equilibrium position a portion of spring 113 will be placed in compression and the spring will provide a force trying to push pin 105 back to its equilibrium position. The equilibrium position is shown in FIG. 9 and is such that pin 105 is in engagement with foot plate bars 103.

Foot plate 101 is a flat plate which is rotatably connected (such as by rod 117, see FIG. 4 ) at its bottom edge to one of the ends of foot plate rods 103.

Foot plate bars 103 are elongated rods which have a series of spaced holes 119 therein and are of a shape and size such that they are snugly and slidably received within tubes 97. Holes 119 are designed and located to receive the ends of pin 105 therein such that foot plate rods 103, and thus foot plate 101 can be locked in a number of positions relative to support board 23, depending on which hole 119 pin 105 is placed in engagement with.

Figure 19:
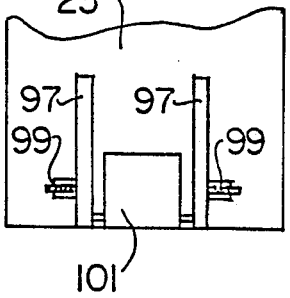
FIG. 19 is a partial bottom view of the backboard and foot plate support assembly illustrated in FIGS. 1, 2, 4, 8 and 9, illustrating the foot plate assembly in the closed or "tucked" position.

Foot plate assembly 29 is designed and arranged such that foot plate 101 can be positioned under backboard 23 (in a closed or "tuck" position) during times when emergency backboard 21 is not in use and when an injured person is being initially placed on emergency backboard 21 (see FIG. 19). In this position, foot plate 101 is under backboard 23 and approximately parallel thereto. Lock pins 105 are in engagement with a pair of holes 119, holding foot plate assembly 29 in this position.

After a person has been placed on support board 23, and it is desired to move foot plate 101 to a position supporting the feet of the person, lock pins 105 can be taken out of engagement with holes 98 and extension rods 103 slid out of receiving tubes 97 until foot plate 101 clears the bottom edge of support edge 23. Foot plate 101 can then be rotated to the upright position and pushed up against the feet of the person on backboard 21. Lock pins 105 are then brought into engagement with another pair of holes 119. A strap, such as strap 110 (see FIG. 8) can then be wrapped around foot plate 101 and the feet of the person to secure the person's feet.

Body strapping members 33 include straps 134 and 136. Each strap 134 and 136 has a ring snap connector 121 attached on one end thereof. Ring snap connectors 121 in turn include rings 123, snap hooks 125, swivel pole 127, cap 129 and swivel base 131.

In the embodiment illustrated in the Figures, strap 134 is longer than strap 136. However, strap 136 has buckle 138 attached at one end thereof. Buckle 138 is designed to receive strap 134 therein and operates in the same manner as a seat belt buckle. Straps 134 and 136 can be comprised of nylon, polyester or any other sufficient flexible and non-resilient material or cloth.

One end of each of the straps 134 and 136 is folded around a ring 123 and then stitched together (forming stitching 133), such that a loop 135 is loosely formed around a ring 123 on that end. This construction results in rings 123 being rotatably and slidably received by loops 135.

Figure 11:
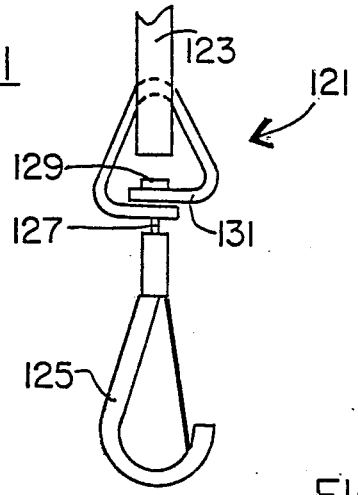
FIG. 11 is a side view of a snap hook assembly which can be employed with the embodiment of this invention illustrated in FIGS. 1 and 2.
Figure 12:
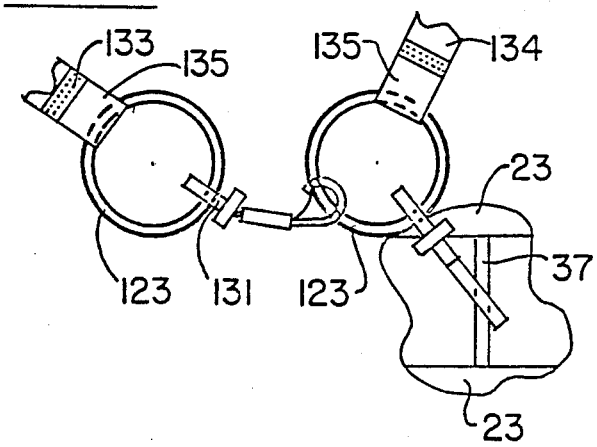
FIG. 12 is a top view illustrating the connection of the ends of two strapping members of this invention to one another and to a backboard according to this invention.

Swivel bases 131, in the embodiment of the invention illustrated in FIGS. 11 and 12, are a continuous rod bent in a triangular shape. Each of the swivel bases 131 slidably and rotatably receives a ring 123 within the triangle.

Snap hooks 125 are connected to swivel bases 131 by swivel poles 127 and caps 129. Snap hooks 125 are attached to one end of swivel poles 127. Swivel poles 127 extend up through swivel base 131 and have caps 129 attached on the other end. Swivel poles 127 are free to rotate relative to swivel base 131 such that snap hooks 125 are free to rotate relative to rings 123 and cloth straps 133.

Snap hooks 125 are designed to be compatible with rods 37, discussed above, such that hooks 125 can be attached to rods 37.

Additional ring snap connectors 121 (other than the ring snap connectors 121 attached to straps 134 and 136) may be employed as discussed below.

Backboard 21 also includes front support: 96 (see FIG. 2) which are a pair of spaced rods attached to the underside on backboard 21. Front supports 96 are of a size and positioned such that support board 23 is approximately level if board 23 is on a flat surface.

The embodiment of this invention described above is employed in the field as follows:

Emergency backboard 21 is designed to be carried on ambulances or other emergency medical mobile units. This is not meant of course to imply that backboard 21 can only be employed in that manner, rather emergency backboard 21 can be employed any time it is necessary to transport and/or immobilize an injured person. For purposes of illustration only, the discussion below is directed at the employment of backboard 21 with an ambulance or other emergency vehicle.

When an emergency vehicle carrying backboard 21 responds to a call where the injured person has suffered a possible injury to his/her back, neck or another type of serious injury wherein movement of the person may result in further injury, it is necessary to immobilize the injured person before and while transporting the person so that further injury to the person's back, neck, etc.,is avoided. Emergency backboard 21 is employed to provide this immobilization and to transport the injured person from the scene of the injury to a medical care facility.

When the emergency vehicle arrives at the location of the injured person, emergency board 21 is positioned next to the injured person, preferably with left head support 25, right head support 27 and body straps 33 removed from support board 23 and with foot plate assembly 29 in the tucked position under support board 25. This provides a flat, unobstructed top surface on support board 23 such that an injured person can be slid or otherwise moved onto support board 23 from any direction without there being any obstacles in the way.

The injured person is then usually positioned, depending on the type of injury sustained, on support board 23 with his/her back on the support board 23, his/her head located on the approximate center of head support track 31 and the body positioned approximately down the center of backboard 21.

Left head support 25 and right head support 27 are then inserted onto support board 23 by inserting the respective track engaging portions 57 of bar supports 49 into head support track 31 and pushing head supports 25 and 27 towards the center of track 31. Latch plate 85 is held in the up position during this time so that latch plate 85 does not contact teeth 45 of track 31 during this movement. Head supports 25 and 27 are pushed towards the center until support pads 47 engage the head of the injured person.

Once head supports 25 and 27 have been properly positioned, latch plates 85 are released such that the lower edges thereof contact track 31 (in particular, teeth 45) and fix head supports 25 and 27 in the desired position.

After head supports 25 and 27 are properly positioned and latched, head straps 69 are employed to further immobilize the head of the injured person. Head straps 69 are woven through strap hooks 53, as discussed above. One head strap 69 is looped through the lower strap hooks 53 and placed under the chin of the injured person. Another head strap 69 is looped through the upper strap hooks 53 and placed, in most cases, against the forehead of the injured person. Both head straps 60 are tightened to the desired degree and attached by bringing the two side patches 73 of VELCRO® into contact with the center patch 71 of VELCRO®.

The body of the injured person is fastened to support board 23 by taking straps 134 and 136, attaching their respective snap hooks 125 to rods 37 (or to a ring 123 of a ring snap connector fastened to rod 37)as desired, and then connecting a strap 134 and a strap 136 to form a complete body strapping member 33. A strap 134 and a strap 136 are attached by inserting the free end of strap-134 into the buckle 138 of strap 136, pulling strap 134 to the desired tightness, and then moving buckle 138 to the latched position.

In FIG. 8, the person illustrated has been strapped to backboard 23 as follows. First, a strap 136 has been attached to the uppermost rod 37 on the right edge of the backboard 23. A strap 134 has been attached to the uppermost rod 37 on the left edge of the backboard 23. These two straps are then buckled together across the chest of the person.

Next, a second strap 136 has been attached to the ring 123 of the strap 134 attached to the uppermost rod 37 on the left edge of backboard 23. Likewise, a second strap 134 has been attached to the ring 123 of the strap 136 attached to the uppermost rod 37 on the right edge of backboard 23.

At the same time, a third strap 136 has been attached to the middle rod 37 on the left edge of backboard 23 and a third strap 134 has been attached to the middle rod 37 on the right edge of right edge of backboard 23. In addition, additional ring snap connectors 121 have been attached to the lowermost rods 37 on each edge of backboard 23.

The second strap 134 was then looped through the ring 123 attached to the middle rod 37 on the left edge of backboard 23, looped through the ring 123 attached to the middle rod 37 on the right edge of backboard 23 and then connected to the second strap 136.

The third strap 134 was then looped through the ring 123 attached to the lowermost rod 37 on the left edge of backboard 23, looped through the ring 123 attached to the lowermost rod 37 on the right edge of backboard 23 and then connected to the third strap 136.

FIG. 8, of course, illustrates only one pattern of strapping members 33 which can be employed to strap a person to a backboard 23. The patterns possible are virtually countless. Also, the number of straps 134 and 136 which can be employed is variable.

As stated above, snap hooks 125 can either be attached to a rod 37 or to a ring 123 of another strap member 33. Through experience with emergency backboards according to this invention, emergency medical personnel may learn how to strap a person onto these backboards such that all the strapping members, by being interconnected, can be connected to backboard 23 on one or two rods 37. This feature enables the injured person to be quickly released from the backboard 21 upon transport to a medical facility since only the one or two key snap hooks would have to be disconnected from rods 37 to release the body straps.

Also, strap members 33 provide emergency medical personnel with great flexibility as to where the strap members 33 can be placed to immobilize the patient. The positioning of the strap members can be varied depending on the injuries incurred and the extent of the injuries. For example, a strap member 33 which is connected to the center rod 37 on one side of a support board 23 (see FIG. 1) can be attached to any rod 37 on the opposite side of the support board 23 or to a ring 121 which is in turn attached to a rod 37 The same is true for all the other strap members. Moreover, more than one strap member 33 can be attached to a rod 37, or the strap members 33 can be interconnected as discussed above.

The feet of the injured person can be immobilized by strapping them to foot plate assembly 29. This is accomplished by moving foot plate assembly 29 from the tucked position to the unfolded position. First, pins 105 are pulled out of engagement with holes 119 in foot plate bars 103. Foot plate bars 103 and foot plate 101 are then free to be pulled out from underneath backboard 23. When foot plate bars 103 have been pulled out a distance such that foot plates 101 are clear of backboard 23, foot plates 101 can be rotated to the upright position. Bars 103 can then be adjusted relative lengthwise to the feet of the injured person such that foot plate 101 contacts the feet of the injured person. Pins 105 can then be released such that pins 105 slide into a pair of complementary holes 119 and lock foot plate assembly in the desired position.

The feet of the injured person can then be attached to foot plate 101 by wrapping strap 110 around the feet and foot plate 101 and connecting the strap to form a closed loop around the feet and the foot plate 101.

When all of these steps have been followed, the injured person will be strapped to a backboard 21 as shown, for example, in FIG. 8. At that time, the person is ready for transport to a medical care facility. Once transported to the medical facility, the injured person released from the support board 23 by disconnecting head straps 69, foot strap 110 and body strap members 33.

Figure 14:
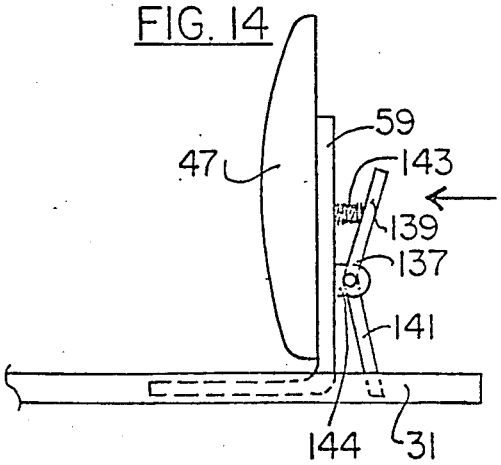
FIG. 14 is a side view of a second embodiment of a head support assembly which can be employed in the practice of this invention.

Another embodiment of the latching assembly for head support assemblies 25 and 27 is shown in FIG. 14. This latching assembly includes latch plate 137, spring 143 and pivot brackets 144. Latch plate 137 is rotatably attached to upright leg 59 of bar support 49 by pivot brackets 144 and consists of two legs, upper leg 139 and lower leg 141. Spring 143 is connected on its ends between upright leg 59 and upper leg 139 and provides a force pushing upper leg 139 away from upright leg 59. This force tends to drive the bottom edge of lower leg 141 into the bottom of track 31 and latches head support assembly (either 25 or 27) in a fixed position.

When it is desired to change the position of a head support assembly embodying the latching assembly illustrated in FIG. 14, one pushes on the front side of upper leg 139, as shown by the arrow in FIG. 14. This brings the bottom edge of lower leg 141 out of contact with the bottom of track 31 and frees the head support assembly for movement relative to track 31. When the force on upper leg 143 is released, lower leg 141 is driven back into contact with track 31 by spring 143 and holds the head support assembly in the new position When the embodiments of the latching assembly illustrated in FIG. 14 are employed, flange 41 of track 31 need not have teeth 45 along the edge thereof, but can have a straight edge, same as flange 43.

Figure 18:
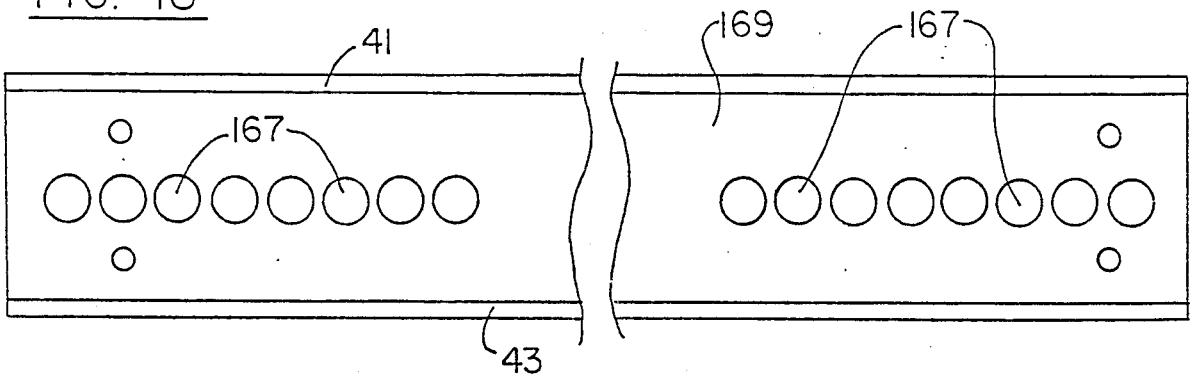
FIG. 18 is a top view of a track which is compatible with the head support assembly illustrated in FIGS. 16 and 17 and with the embodiment of this invention illustrated in FIGS. 1 and 2.
Figure 17:
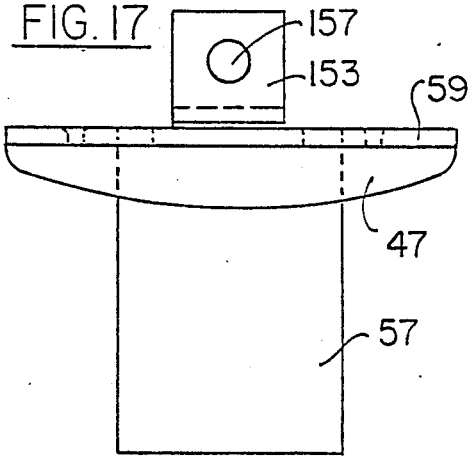
FIG. 17 is a top view of the head support assembly illustrated in FIG. 16 with the latch pin removed.
Figure 16:
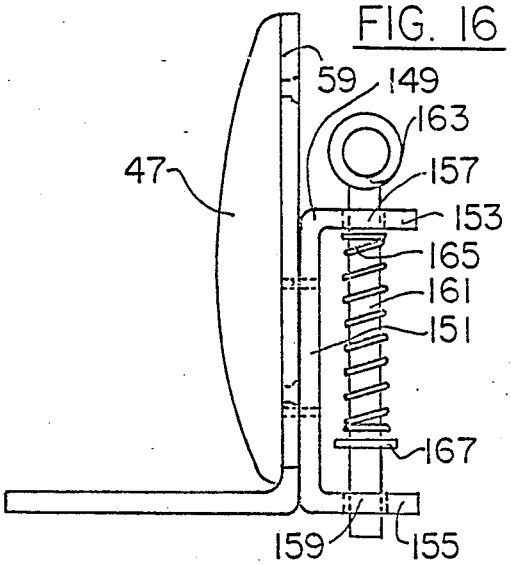
FIG. 16 is a side view of a third embodiment of a head support assembly which can be employed with the embodiment of this invention illustrated in FIGS. 1 and 2.

Yet another embodiment of a latching assembly compatible with head support assemblies 25 and 27 is illustrated in FIGS. 16 and 17. This embodiment is designed to be employed with a track different from track 31 previously described, such as track 169 illustrated in FIG. 18.

Track 169 is basically the same as track 31, with retaining flanges 41 and 43, but in addition, track 169 has spaced holes 168 along the bottom thereof. Holes 168 are designed to be compatible with pin 161 as discussed below.

Holes 168 are in either two spaced sets, one for each head support assembly 25 and 27, or in a continuous row forming a path along the length of track 169. In this regard, it is noted that track 169, as well as track 31 previously discussed, can be a continuous track, or can be two tracks beginning at the respective longitudinal edges of support board 23 and extending less than half way across board 23 such that a gap or space is formed between the two tracks.

The latching assembly illustrated in FIGS. 16 and 17 includes channel 149, pin 161, coil spring 165 and ring 167. Channel 149 is comprised of web 151, top flange 153 and bottom flange 155. Web 151 is bolted or otherwise attached to upright leg 59 of support guide 49. Flanges 153 and 155 extend perpendicularly away from upright leg 59 and have holes 157 and 159, respectively, therethrough. Pin 161 is received by holes 157 and 159.

Ring 167 is affixed to pin 161 between flanges 153 and 155. Coil spring 165 encompasses a portion of pin 161 and abuts on its ends with ring 167 and the bottom surface of flange 153. Coil spring 165 is in compression whenever the head support assembly embodying spring 165 is fully engaging track 169. This spring force causes pin 161 to positively engage a hole 168.

Pin 161 has a ring 163 at the top thereof for easy handling When one wants to slide a head support assembly including this latch assembly into a track 169, or if pin 161 is in engagement with a hole 168 and one desires to unlatch pin 161 from the hole 168, one pulls up on ring 163 until the bottom of pin 161 is free of hole 168. The head support assembly is then free to be slid relative to track 169.

Figure 15:
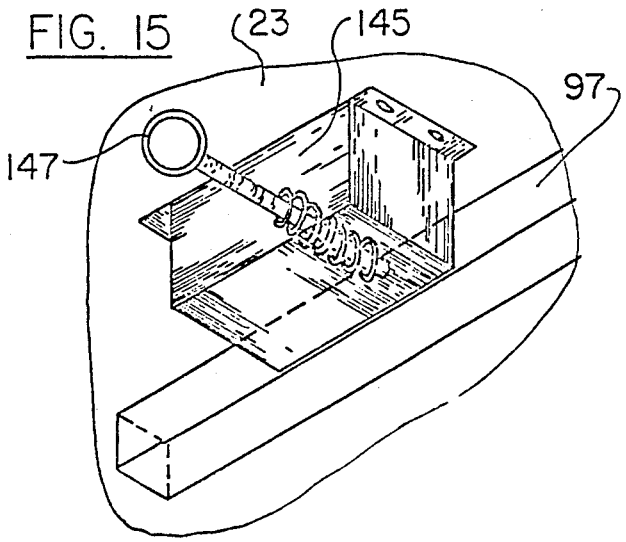
FIG. 15 is a perspective view (taken from the underside of a backboard) of a second type of latching assembly which can be employed with the embodiment of the foot plate assembly illustrated in FIGS. 2 and 4.

FIG. 15 illustrates another embodiment of the lock assembly which can be employed with foot plate assembly 29. This lock assembly is basically the same as the lock assembly previously discussed, but includes ring 147 instead of knob 111 on the outer end, for easier gripping. Moreover, the lock assembly is located in housing 145 to protect the assembly from damage, dirt, grime, etc.

Once given the above disclosure, other modifications, embodiments and improvements will become apparent to the skilled artisan. These other modifications , embodiments and improvements are considered to be within the scope of this invention as defined by the following claims.

I claim:

1. A backboard for transporting an injured person comprising:

a rigid support board of a size sufficient to lay a person thereon, means for strapping said person said board, and means for supporting the head and neck of said person, said head and neck supporting means includes a track which is connected to said board and two substantially opposing head engaging devices which are slidably received by said track, said head engaging devices including head supporting means and support guide where by said supporting means is attached to said guide, projects above said board, and is adapted to directly abut an immobilize the person's head, and said guide having a first and second leg fixedly attached to one another at an angle where said head supporting means is attached to said second leg and said first leg interfaces with said track, and means for latching said head engaging devices in a number of positions relative to said track, wherein each of said latching means includes a latch member having at least two positions, a latch position and a free position, and said latching means being designed and arranged such that said second legs are free to move relative to said track when the latch members are in the free position and such that said second legs are stopped from moving relative to the track when the latch members are in the latch position.

2. A backboard according to claim 1 wherein each of said latching means includes a spring, said spring being biased to hold said latch member in the latch position.

3. A backboard according to claim 1 wherein said track is embedded transversely in said support board.

4. A backboard according to claim 3 wherein said latch member is slidably attached to said support guide.

5. A backboard according to claim 4 wherein said track has two side edges, one of said edges having spaced notches therein, said latch member engaging said notches when said hatch member is in the latch position.

6. A backboard according to claim 5 wherein said latch member is a plate.

7. A backboard according to claim 4 wherein said track has spaced holes in the bottom thereof, said latch member engaging said holes when said latch member is in the latch position.

8. A backboard according to claim 7 wherein said latch member is a rod.

9. A backboard according to claim 1 wherein said support guide includes a first and a second leg, said first leg being perpendicular to said second leg, said first leg being designed and arranged to interface with said track, said second leg having the head support pad and said latch member attached thereto.

10. A backboard according to claim 1 wherein said support board has handholds spaced along each longitudinal edge of said support board, said support board further comprising rods spanning a selected number of said handholds, said strapping means including strapping members, said strapping members being designed and arranged to be connectable to said rods.

11. A backboard according to claim 10 wherein each of said strapping members includes:

a cloth strap, a ring, a snap hook, said ring being slidably and rotatably retained by one end of said cloth strap, said snap hook being swivelly connected to said ring.

12. A backboard according to claim 10 wherein said strapping members included:

a first and a second strap, each of said straps having a connector attached on one end thereof, said first strap having a buckle attached on the other end thereof, said connectors including a ring and a snap hook, said snap hook being swivelly connected to said ring.

13. A backboard according to claim 1 further comprising means for supporting the feet of an injured person when said person is placed on said backboard, said feet supporting means being adjustable to a number of positions relative to the support board.

14. A backboard according to claim 13 wherein said feet supporting means includes a foot plate, extension rods and means for latching said extension rods in fixed positions relative to said support board, said latching means having a free position and a latch position, said extension rods being movable relative to the support board when said latching means is in the free position, said foot plate being rotatably attached to said extension rods.

15. A backboard according to claim 14 wherein said feet supporting means is designed and arranged such that said extension rods and said foot plate are positionable under said support board when the feet supporting means is not in use.

16. A backboard according to claim 1 further comprising at least one strapping member for employment with a backboard for transporting an injured person, including a clutch strap, a ring, a snap hook, said rim being slidably and rotatably retained by one of the ends of said cloth strap, said snap hook being swivelly connected to said ring.

17. A head restraining device for use with an emergency backboard having a track, said device comprising:

two spaced and opposing head engaging members, wherein said head engaging members have a head supporting means and a support guide, said supporting means projecting above the board and at least one of said members has a support guide fixedly attached at an angle to the supporting means, said guide means having a first leg which is designed and arranged to be connected to and slidable along said track, and a second leg to which said supporting means is attached, and means for latching said support guide in a number of positions relative to the track, said latch means having at least two positions, track engaging position and a free position, said latch means being movably attachable to said second leg, said latching means begin designed and arranged such that said head engaging members are free to move relative to the track when the latching member is in the free position where said head engaging members are movable to directly abut the sides of a victim's head.

18. A head restraining device according to claim 17, further comprising:

means for engaging straps, wherein each of said head engaging members includes at least one of said strap engaging means.

19. A head restraining device according to claim 18 further comprising head straps, said head straps being designed and arranged to engage said strap engaging means when said device is being employed.

20. A head restraining device according to claim 17 wherein said head engaging members include a head support pad and a support guide, said support guide having a second leg, said second leg, being at an angle to said first leg and said head support pad and said latch member being attached to said second leg.

21. A head restraining device according to claim 20 wherein said latching member is slidably connected to said guide.

22. A head restraining device according to claim 17 wherein said latching member is rotatably connected to said guide.

23. A head restraining device according to claim 17 wherein said head engaging members are designed and arranged such that the head engaging members can be disengaged from the track.

24. A head restraining device according to claim 17 wherein said head restraining members are designed and arranged such that said head restraining members slide in said track transversely to said backboard.

25. A head restraining device according to claim 17 wherein said head engaging members include a head support pad and a support guide, said support guide having a first leg and a second leg, said first leg being at an angle with said second leg, said first leg being designed and arranged to interface with said track, said head support pad and said locking means being attached to said second leg.

26. A backboard for transporting an injured person comprising:

a rigid support board of a size sufficient to lay a person thereon, means for strapping said person on said board, a track which is connected to said board, two head engaging device which are slidably received by said track, said head engaging devices incorporating a head support and a support guide, said head support being attached to said guide, said guide having a first and second leg where said first leg is designed and arranged to interface with said track and said second leg has a head support adapted to project above said board and abut the side of the person's head, said engaging devices further including means for latching said head engaging devices in a number of positions relative to said track, wherein each of said latching means includes a latch member having at least two positions, a latch position and a free position, said latching means being movably attached to said second guide leg and designed and arranged such that said head engaging devices are free to move relative to said track when the latch members are in the free position and such that said head engaging members are stepped from moving relative to the track when the latch members are in the latch position.

27. A backboard according to claim 26 wherein said latch member is rotatably attached to said support guide.

28. A backboard according to claim 27 wherein said latch member is a bent plate having a top and a bottom leg, said legs being at an angle with each other, said bottom leg abutting said track when said latch member is in the latch position, spring extending between said top leg and said support guide.

29. A head restraining and immobilization device for use with an emergency backboard, said device, comprising:

a first and a second spaced and laterally opposing head engaging members, each of said members including padding on respective opposing surfaces for directly abutting a head, a track means for positionally stabilizing said head engaging members in a spaced opposing relationship and permitting said opposing head engaging members to be fixedly positioned at a desired distance from one another, said track means featuring a laterally extending engageable portion, an elongated supporting member attached to said first engaging member in a manner where said supporting member and engaging member are immovable relative to each other, an elongated support guide fixedly attached at an angle to said supporting member, extending laterally therefrom and substantially parallelly to said track means, said support guide being engageable with said engageable portion of said track means and laterally translatable relative to said track means, unitary locking means associated with said support guide for securing said support guide to said engageable portion of said track means at a desired location therealong, said locking means being adapted to be in an engaging position where said guide is fixedly positioned relative to said track means to prevent movement of the victim's head in a plane parallel to the backboard and a free position, a strap connection element associated with each of the first and second head engaging members, and a strap extending parallel to said track means and between and over said head engaging members secured to said strap connection elements, said strap positionally stabilizing in the perpendicular direction the victim's head to the backboard, where after the victim's head engages said second engaging head engaging member, the first head engaging member is moved relative to said track means to engage the victim's head, the locking means is so engaged to fixedly position the support guide and the head engaging member and the head is positionally stabilized in three dimensions relative to the backboard with the strap.

30. A head restraining and immobilization device for use with an emergency backboard, said device, comprising:

track, a first and a second spaced and opposing head engaging members, an elongated supporting member attached to said first engaging member in a manner where said supporting member and engaging member are immovable relative to each other, an elongated support guide fixedly attached at an angle to said supporting member and translatable relative to said track, spring biased locking means for securing said support guide to said track at a desired location therealong, said locking means being spring biased in an engaging position where said guide is fixedly positioned relative to said track to prevent movement of the victim's head in a plane parallel to the backboard and a free position where said guide is translatable relative to said track, a strap connection element associated with each of the first and second head engaging members, and a strap extending parallel to said track and between and over said head engaging members secured to said strap connection elements, said strap positionally stabilizing in the perpendicular direction the victim's head to the backboard, where after the victim's head engages said second engaging head engaging member, the first head engaging member is moved relative to track to engage the victim's head, the locking means is so engaged to fixedly position the support guide and the head engaging member and the head is positionally stabilized in three dimensions relative to the backboard with the strap.

31. A backboard for transporting an injured person comprising:

a rigid support board of a size sufficient to lay a person thereon, means for strapping said person on said board, and means for supporting the head and neck of said person, said head and neck supporting means includes a track which is connected to said board, said track having two sides edges where one of said edges has spaced notches therein, and two substantially opposing head engaging devices which are slidably received by said track, said head engaging devices including head supporting means and support guide where said supporting means includes a pad attached to said guide, projects above said board, and is adapted to directly abut and immobilize the person's head, and said guide having a first and second leg where said head supporting means is attached to said second leg and said first leg interfaces with said track and means for latching said head engaging devices in a number of positions relative to said track wherein each of said latching means is slidably attached to said support guide and includes a latch member having at least two positions, a latch position and a free position, and said latching means including a spring, said spring being biased to hold said latch member in the latch position, said latching means engaging said notches when in the latch position, said latching means being designed and arranged such that said second legs are free to move relative to said track when the latch members are in the free position and such that said second legs are stopped from moving relative to the track when the latch members are in the latch position.

32. A backboard according to claim 31 wherein said latch member is a plate.

33. A backboard for transporting an injured person comprising:

a rigid support board of a size sufficient to lay a person thereon, means for strapping said person on said board, and means for supporting the head and neck of said person, said head and neck supporting means includes a track which is connected to said board and two substantially opposing head engaging devices which are slidably received by said track, said head engaging devices including a padded head supporting means and support guide where said supporting means is attached to said guide, projects above said board, and is adapted to directly abut and immobilize the person's head, and said guide has a first and second leg perpendicular to each other, where said padded head supporting means is attached to said second leg and said first leg interfaces with said track, and means for latching said head engaging devices in a number of positions relative to said track, wherein each of said latching means includes a latch member having at least two positions, a latch position and a free position, said latching means being designed and arranged such that said second legs are free to move relative to said track when the latch members are in the free position and such that said second legs are stopped from moving relative to the track when the latch members are in the latch position.

34. A backboard for transporting an injured person comprising:

a rigid support board of a size sufficient to lay a person thereon, means for strapping said person on said board, and means for supporting the head and neck of said person, said head and neck supporting means includes a track which is connected to said board and two substantially opposing head engaging devices which are slidably received by said track, said head engaging devices including head supporting means and support guide where said supporting means is attached to said guide, projects above said board, and is adapted to directly abut and immobilize the person's head, and said guide having a first and second leg where said head supporting means is attached to said second leg and said first leg interfaces with said track and means for latching said head engaging devices in a number of positions relative to said track, wherein each of said latching means includes a latch member rotatably attached to said support guides, the member comprising a bent plate having a top and a bottom leg, said legs being at an angle with each other, said bottom leg abutting said track when said latch member is in the latch position, and a spring extending between said top leg and said support guide, such that the latch member has at least two positions, a latch position and a free position, said latching means being designed and arranged such that said second legs are free to move relative to said track when the latch members are in the free position and such that said second legs are stopped from moving relative to the track when the latch members are in the latch position.

35. A head restraining device for use with an emergency backboard having a track, said device comprising:

two spaced and opposing head engaging members, wherein said head engaging members have a head supporting means including a support pad and a support guide, said supporting means projecting above the board and said guide means having a first leg which is designed and arranged to be slidably received by said track, and a second leg being at an angle to said first leg to which said supporting means is attached, and means for latching the head engaging members in a number of positions relative to the track, said latch member having at least two positions, a track engaging position and a free position, said latch member being movably attached to said second leg, said head support pad being attached to the second leg, said latching means being designed and arranged such that said head engaging members are free to move relative to the track when the latching member is in the free position, said head support pad being attached to said second leg.

36. A head restraining device according to claim 35 wherein said latching member is slidably connected to said guide.

* * * * *